US006135186A

United States Patent [19]

Lindley, Jr.

[11] Patent Number: 6,135,186

[45] Date of Patent: Oct. 24, 2000

[54] WINDOW SCREEN ASSEMBLY AND METHOD

[76] Inventor: Jack R. Lindley, Jr., 1911 Shirley Dr., Burlington, N.C. 27215

[21] Appl. No.: 09/323,536

[22] Filed: Jun. 1, 1999

Related U.S. Application Data

[63] Continuation-in-part of application No. 09/116,869, Jul. 16, 1998, abandoned.

[51] Int. Cl.[7] ..... A47H 1/00

[52] U.S. Cl. ..... 160/23.1; 160/28; 160/100; 160/301

[58] Field of Search ..... 160/23.1, 27, 28, 160/99, 100, 300, 301, 323.1, 383

[56] References Cited

U.S. PATENT DOCUMENTS

| | | | |
|---|---|---|---|
| 1,177,434 | 3/1916 | Montgomery et al. | 160/28 |
| 1,188,411 | 6/1916 | Burrowes | 160/28 |
| 1,459,155 | 6/1923 | Ioor | 160/28 X |
| 3,105,542 | 10/1963 | Lynch | 160/28 |
| 3,155,146 | 11/1964 | Malouf et al. | 160/27 |
| 4,674,550 | 6/1987 | Graves | 160/301 X |
| 5,123,473 | 6/1992 | Henkenjohann | 160/264 |

*Primary Examiner*—David M. Purol

[57] ABSTRACT

A retractable window screen assembly which includes a housing easily mounted on an existing double hung sliding window sill or similar type is disclosed. The screen is wound about a spring mounted core and extends from the housing when the window is opened to cover the open space. A pivot bar provides screen to sash rotation to prevent binding when the sash yaws during opening or closing. The core includes a c-shaped member for easy attachment to a generally cylindrical member and a U-shaped member attaches the free end of the screen to the pivot bar.

14 Claims, 9 Drawing Sheets

WINDOW SCREEN ASSEMBLY AND METHOD

This is a continuation-in-part of application Ser. No. 09/116,869 filed Jul. 16, 1998, now abandoned, the entire contents of which are incorporated by reference.

BACKGROUND OF THE INVENTION

1. Field of the Invention

This invention pertains to an improved retractable window screen assembly and method for a double hung or similar sliding type window.

2. Description of The Prior Art And Objectives Of The Invention

Co-pending application Ser. No. 08/740,389 provides a thoughtful and organized rationale for the desirability of a retractable window screen, particularly one with a pivot bar for the free end of the screen. The entire disclosure of application Ser. No. 08/740,389, now U.S. Pat. No. 5,915,443 is hereby incorporated by reference. The device disclosed in the 389 application is not particularly well suited for retrofitting into existing double hung or similar sliding type windows, nor is the screen particularly easy to replace in all instances.

With the aforesaid needs and concerns, the present invention was made, and it is an objective of the present invention to provide a spring-loaded retractable window screen assembly which is easily retrofit into existing windows of the double hung type.

It is a further objective of the present invention to provide a window screen assembly in which it is easy to replace damaged screens.

It is still a further objective of the present invention to provide a retractable window screen with a pivot bar to prevent binding as the window is opened or closed.

It is yet a further objective of the present invention to provide a pivot bar with a key hole shaped aperture for easy attachment and removal from a window sash.

It is another objective to provide a two-piece spring-loaded core upon which the screen is wound.

It is still another objective to provide a method of installing the present invention in existing double hung window sills, stools or interior trim.

It is yet another objective to provide a two-piece pivot bar, one piece of which is permanently attached to a screen.

These and other objectives and advantages will become readily apparent to those skilled in the art upon reference to the following detailed description and accompanying drawings.

SUMMARY OF THE INVENTION

The aforesaid objectives and advantages are realized by providing a stool or interior trim mounted retractable window screen assembly. The screen is wound about a tensioned spring-loaded core contained within a housing. The screen unwinds from the core as the window sash is raised, thereby providing a screen for the now opened window. The screen rewinds about the core when the sash is lowered, thus providing an unobstructed view through the closed window.

Because the sash may yaw as it is raised or lowered, there is a need for a means to pivot the screen relative to the sash to prevent binding or tension. This is accomplished by providing a perpendicular member, such as a stud or screw, in the center of the sash. Suspended therefrom is a two-piece pivot bar. The first piece of the pivot bar is rigidly affixed to the screen and is slidably positioned in the second piece. The second piece defines a keyhole shaped aperture which is selectively positionable over the screw, which allows the screen to rotate or pivot relative to the sash and prevent excess slackness or binding.

The opposite end of the screen is attached to a c-shaped member, for "snap" fitting onto a spring-loaded, elongated core. The core is tensioned and is generally cylindrically shaped having first and second levels or diameters. The jaws of the c-shaped member snap over the first level and complete the outer cylinder shape. The core is then wound to tension the screen properly. This arrangement allows the easy replacement of damaged or worn screens. A method of installing the assembly is also disclosed in more detail below.

All drawings are sized to clearly illustrate the specific components therein and are not of uniform size or scale.

DETAILED DESCRIPTION OF THE PREFERRED EMBODIMENTS AND OPERATION OF THE INVENTION

Figure 1:
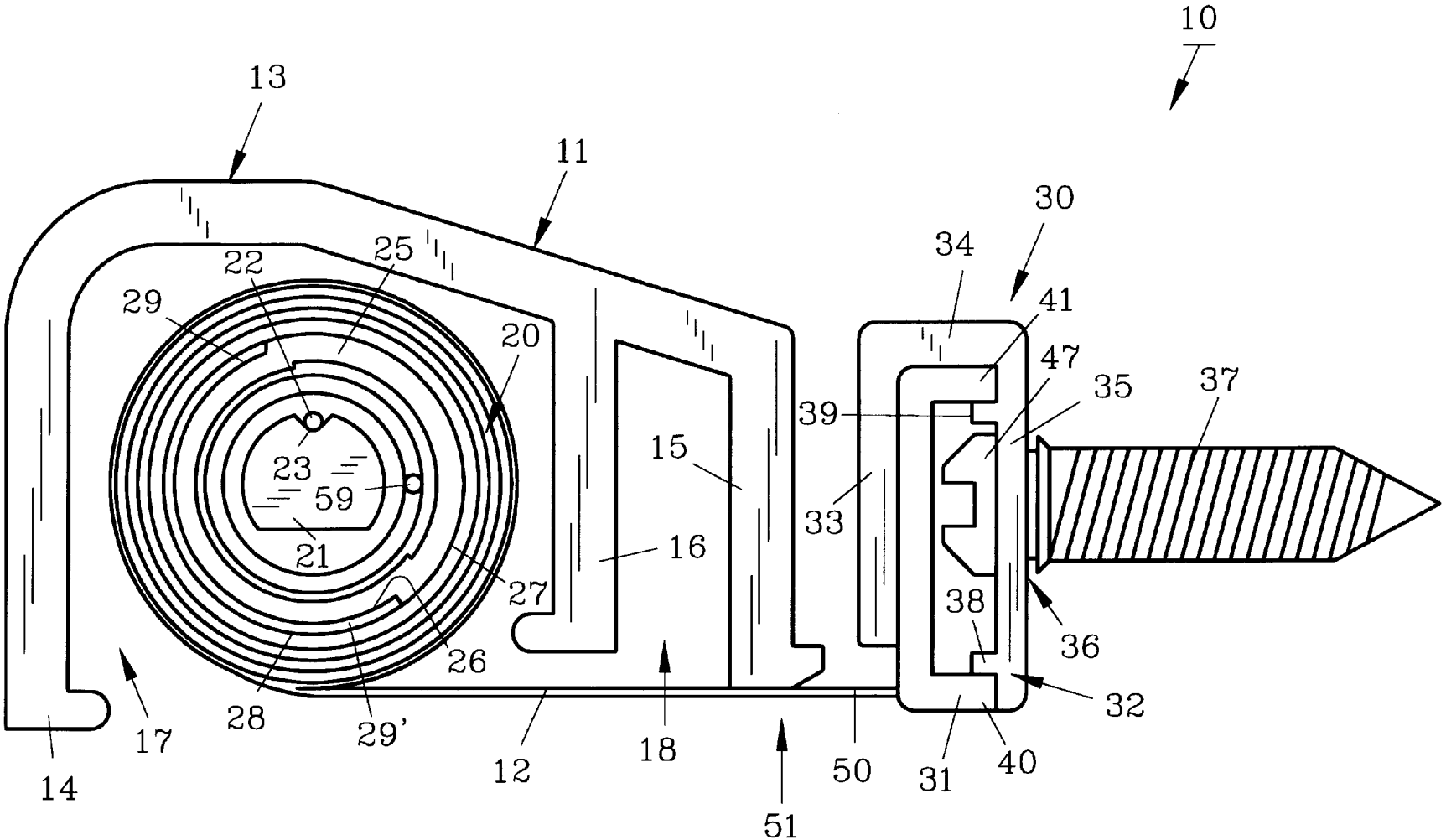
FIG. 1 shows an enlarged end view of the window screen assembly of the present invention prior to installation in a window.
Figure 3:
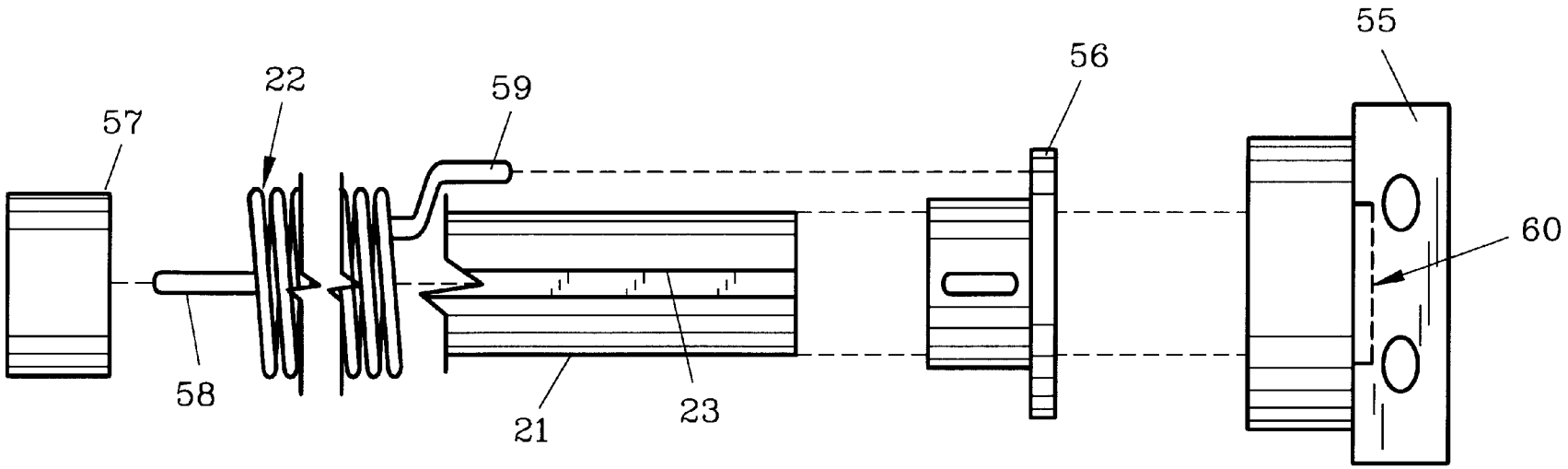
FIG. 3 features an exploded view of the D-shaft, spring, bushing and end cap, removed from the housing.

Turning now to the drawings, specifically FIG. 1 shows retractable window screen assembly 10 which comprises housing 11, screen 12, core 20 and pivot bar 30. Housing 11, which can be mounted on a window sill, stool or interior trim is formed from preferably an extruded plastic material, although metal or the like is also acceptable. Housing 11 comprises top 13 and legs 14–16 which depend therefrom to form first chamber 17 and second chamber 18. Leg 15 together with end caps 55 (only one shown) (FIG. 3) defines aperture 51 with a window stool (not shown) through which free end 50 of screen 12 extends. End caps, such as end cap 55 (FIG. 3) are positioned on each end of housing 11 during mounting to position the housing for a screen aperture and to prevent debris entry and for aesthetic purposes. These end caps may be, but not preferably, integrally formed with housing 11.

End cap 55 (seen in FIG. 3) also rigidly positions extruded D-shaft 21 within cavity 60. D-shaft 21 defines u-channel 23 which holds first end 58 of metal coil spring 22. Retaining clip 57 holds first end 58 within channel 23. Second spring end 59 extends through an aperture (not shown) in bushing 56, which is in turn rigidly affixed to inner core section 25 (FIG. 1). Bushing 56 is contained within end cap 55 and turns thereagainst. Note that while only one end of D-shaft 21 is shown, an identical bushing and end cap are positioned on the other end (not seen) of D-shaft 21.

Inner core section 25 in FIG. 1 is generally cylindrical, but bi-leveled, shown as first level 26 and second level 27, with second level 27 having a greater radius than first level 26. Completing core 20 and having the same outer radius as second level 27 is outer core section 28 which is rigidly affixed to screen 12 and acts to clip or snap screen 12 to inner section 25. Adhesives, welds, screws or the like may be used to rigidly affix screen 12 to outer section 28. Outer section 28 is preferably c-shaped with opposing jaws 29 and 29' which "snap" over inner core section 25 and effectively, selectively attach screen 12 to inner section 25.

Figure 2:
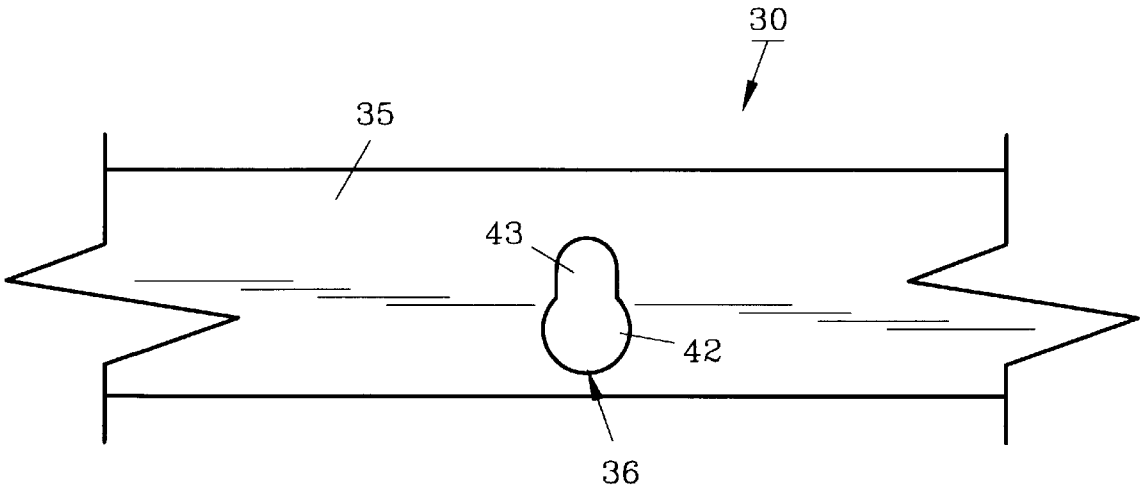
FIG. 2 illustrates a front elevational view of a partial pivot bar of the present invention prior to installation on the sash.

Pivot bar 30 (FIG. 1) comprises first section 31 which is generally U-shaped and is rigidly affixed to screen 12 by an adhesive, welding, friction fitting or the like. Second section 32 has a general inverted U-shaped comprising front 33, top 34 and back 35. Back 35 defines keyhole shaped aperture 36 as seen in FIG. 2 which receives screw 37 (FIG. 1). Back 35 also comprises pegs 38 and 39 which capture ends 40, 41 of first section 31 and selectively, frictionally hold first section 31 and second section 32 together.

As noted, screen 12 is rigidly and permanently affixed to outer section 28 and first section 31. This allows easy replacement of screen 12 for example when it is inadvertently torn or damaged. By slidably releasing first section 31 from second section 32 and removing outer section 28 from inner section 25, the new screen can be snapped into place. This is particularly convenient since screen 12 must be perfectly square both in shape and as installed. Any irregularities in shape or squareness will cause distortions in the screen during use, which is undesirable.

Also as noted, FIG. 2 shows keyhole shaped aperture 36 in back 35 of pivot bar 30. Head 47 (FIG. 1) of screw 37 fits within large end 42 of aperture 36 and slides upwardly to narrow end 43 to provide rotation for pivot bar 30, much as disclosed in co-pending application Ser. No. 08/740,389. U-shaped vertical side channels such as disclosed in the '389 application may also be used to help guide screen 12 as it moves in and out of housing 11.

Figure 4:
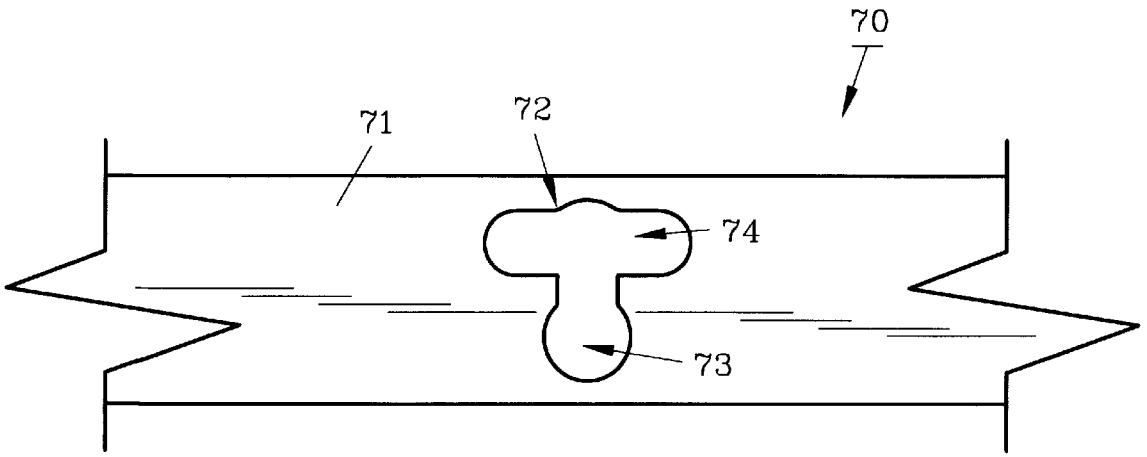
FIG. 4 demonstrates a front elevational view of an alternate partial pivot bar of the present invention prior to installation on the sash.

Alternately, as seen in FIG. 4, pivot bar 70 may be used. Pivot bar 70 includes elongate portion 71 which defines keyhole aperture 72. Aperture 72 includes generally circular entry point 73 and longitudinally open portion 74. Aperture 72 is particularly useful with warped window stops and jambs (not shown) where the center of the sash may not be the most convenient place for pivot bar 70 to be located. Longitudinally open portion 74 allows for horizontal motion of pivot bar 70 relative to screw 37 in order to provide the most effective screen to sash rotation.

The preferred method of installing window screen assembly 10 into an existing double hung window includes drilling spaced holes in the interior trim, sill or stool (not shown). Another hole is drilled into the center of the sash front (not shown) and screw 37 is placed therein. Outer section 28 is snapped onto inner section 25 which is connected by bushing 56 to spring 22 and thence to D-shaft 21 therein. Screen 12 is manually wound around core 20. Pliers or the like are then used to turn core 20 relative to D-shaft 21 approximately 35 to 40 rotations in order to properly tension spring 22. The number of rotations will vary, depending on the particular spring employed. D-shaft 21, together with tensioned core 20 is then positioned in end caps 55 and in housing 11 leaving screen free end 50 extending from aperture 51. Housing 11, together with end caps 55 are then screwed or mounted on the sill, stool or interior trim, and free end 50 with first section 31. First section 31 is pulled outwardly and slid into place on second section 32 from one end thereof and is attached to screw 37 on the sash before spring 22 is tensioned. As discussed above, screen 12 may be replaced as needed by removing housing 11 from the sill and performing the operations discussed above.

Figure 5:
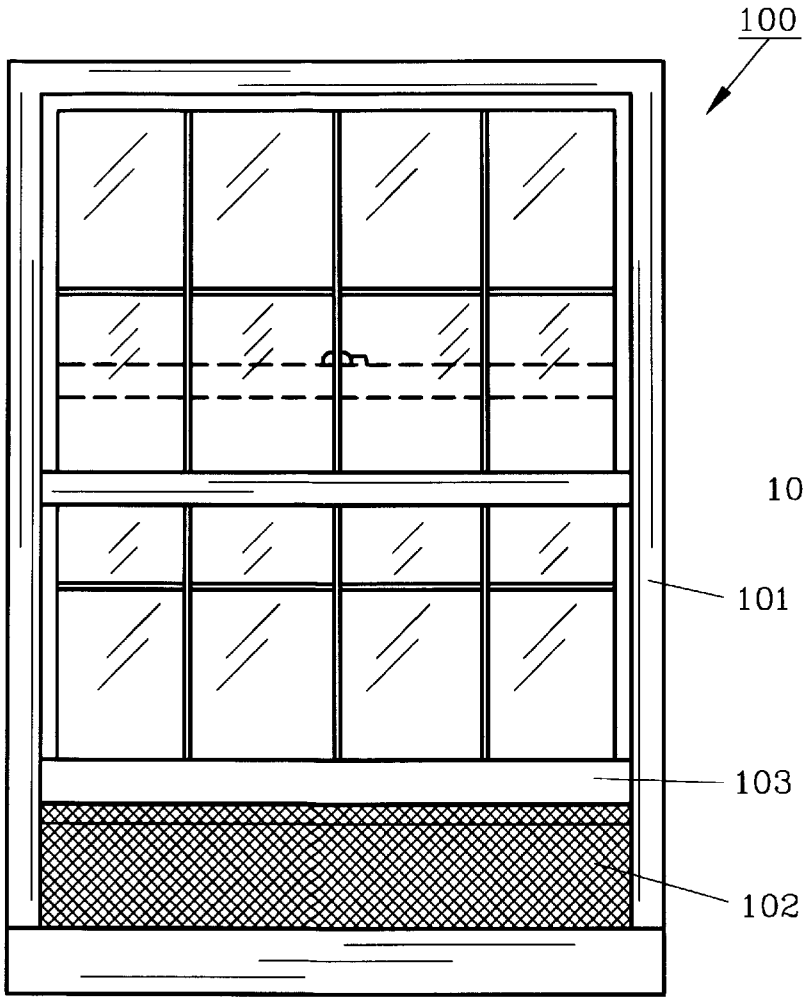
FIG. 5 pictures the present invention in operation as installed in a conventional double hung window.

In an alternative new preferred embodiment, improvements have been made to the spring-loaded core and the method of attachment to the window, as better seen in FIGS. 5–17. Specifically, FIG. 5 shows exterior 101 of window 100 with screen 102 partially extended as lower sash 103 is partially raised from the sill.

Figure 6:
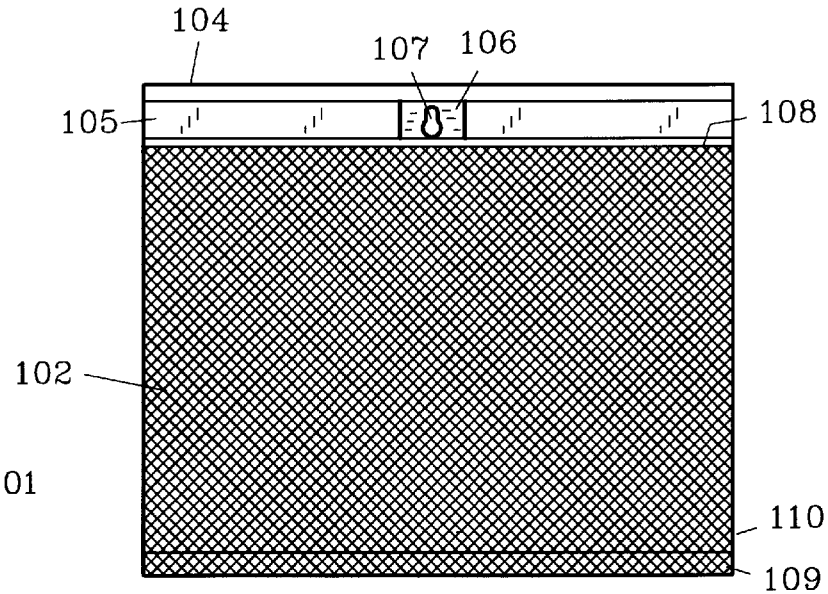
FIG. 6 shows the screen removed from the window of FIG. 5.

As seen in FIG. 6, screen 102 is attached to screen rail 104 via slide 139 (FIG. 14) along upper edge 108 of screen 102. Slide 139 thus allows for easy manual assembly with screen rail 104 in back groove 140. Screen rail 104 which acts as a pivot bar also defines front groove 105 therein for reception of slidable hanger 106. Slidable hanger 106 defines key hole aperture 107. Screen 102 is attached at its lower end to c-shaped outer section 109 along lower edge 110. Screen 102 is attached to the exterior surface of c-shaped outer section 109 such as with an adhesive. This attachment to the exterior surface of c-shaped section 109 allows for a superior, precise fit of c-shaped outer section 109 with inner section 126 (See FIG. 18) and a uniform taut screen.

Figure 8:
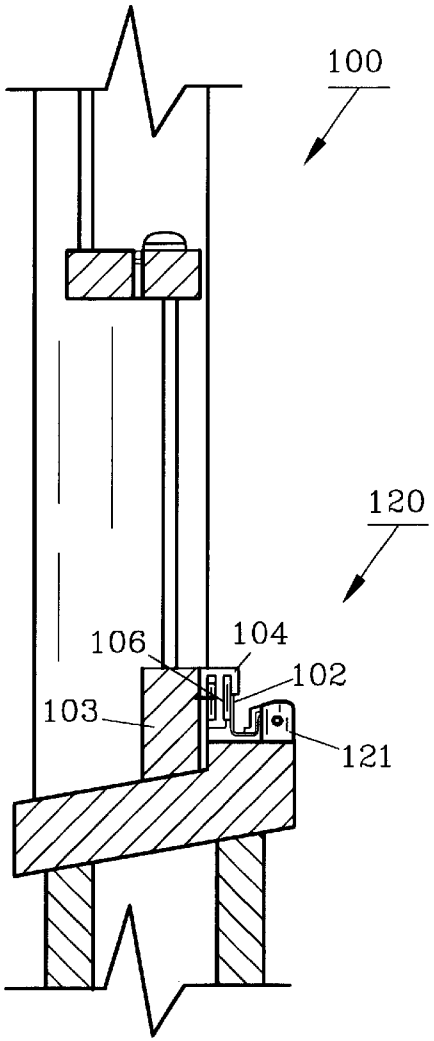
FIG. 7 and FIG. 8 demonstrate cross-sectional views of the window of FIG. 5 in both a partial open and closed position.
Figure 7:
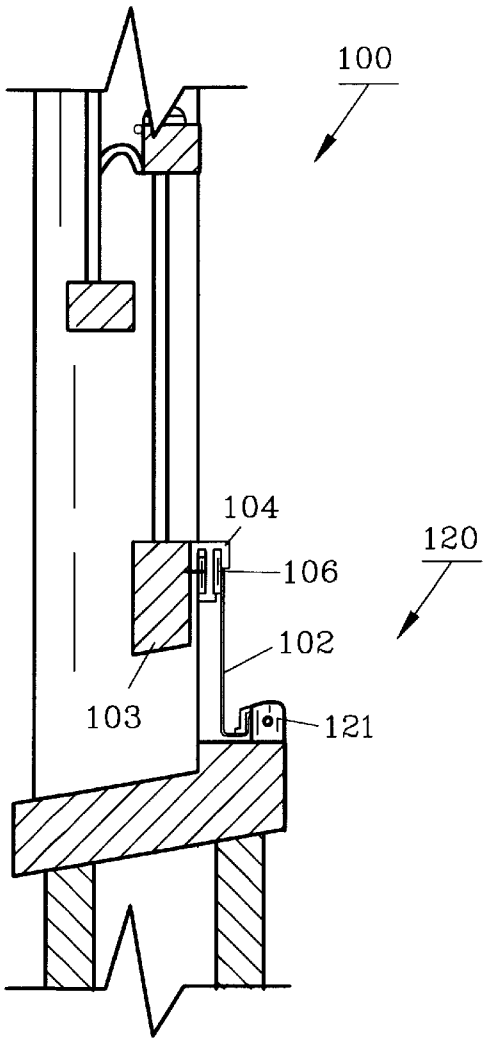

FIGS. 7 and 8 show screen 102 in both a partially open and closed position respectively. Window screen assembly 120 comprises screen rail 104, screen 102 and housing 121.

Figure 9:
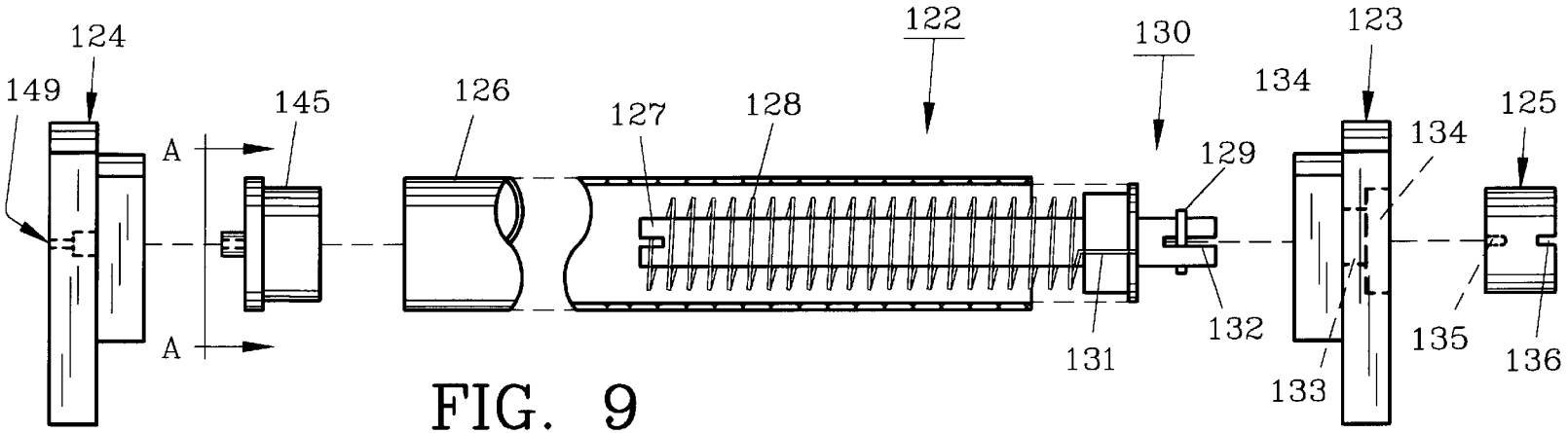
FIG. 9 features an exploded partial cross-sectional view of the core and end caps of the housing.

In FIG. 9 an exploded, partial cross-section of spring-loaded core 122, along with first end cap 123, second end cap 124 and end plug 125 are seen. Core 122 comprises inner section 126 which contains spring axle 127 and spring 128 therein. At terminal end 130 of spring axle 127 is spring end piece 131. Spring axle 127 defines slot 132 for receiving s-shaped metal pawl 129. First end cap 123 defines toothed race 133 and plug race 134 therethrough. Plug race 134 receives end plug 125 therein. End plug 125 defines tongue 135 and outer slot 136. The outer c-shaped section 109 is not seen in FIG. 9 for clarity purposes.

Figure 9A:
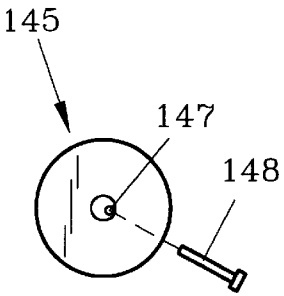
FIG. 9A illustrates a front view of the end cap with a locking aperture and pin.

FIG. 9A demonstrates an end view of core hub 145 which includes locking pin aperture 147 positioned slightly off center. Aperture 147 acts as a locking mechanism for core 122. Locking pin 148 can be slid through aperture 149 of end cap 124 into aligned aperture 147 of core hub 145. With pin 148 so placed, core 122 is then held (preferably with c-shaped outer section 109 upward) in place under tension. This allows easy removal and access of screen 102 without the necessity of having to rewind spring 128 after screen 102 has been replaced. Other types of core locking devices may be employed such as a spring-loaded pin or other mechanisms to allow spring-loaded core 122 to remain under tension as screen 102 is exchanged, when screen 102 for example is damaged or worn.

Figure 10:
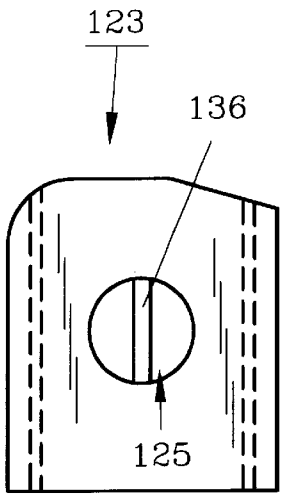
FIG. 10 presents an exterior view of the first end cap of the present invention.
Figure 11:
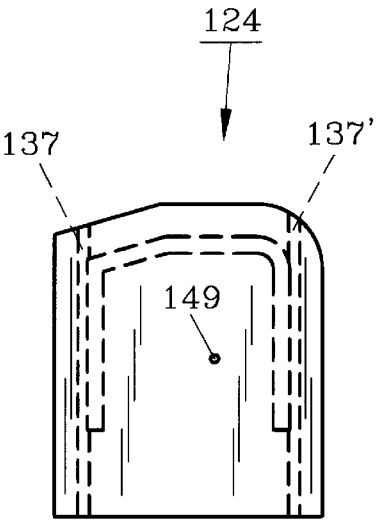
FIG. 11 depicts an exterior view of the second end cap of FIG. 9.

In FIG. 10, first end cap 123 receives end plug 125 exposing end plug slot 136. As seen in FIG. 11 second end cap 124 defines screw channels 137, 137' which are used for receiving screws to hold end cap 124 to the window sill or stool.

Figure 13:
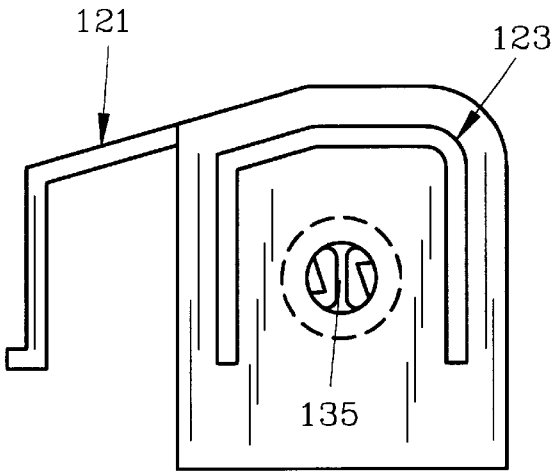
FIGS. 12 and 13 show the housing and end cap of the present invention before and after assembly with an end plug.
Figure 12:
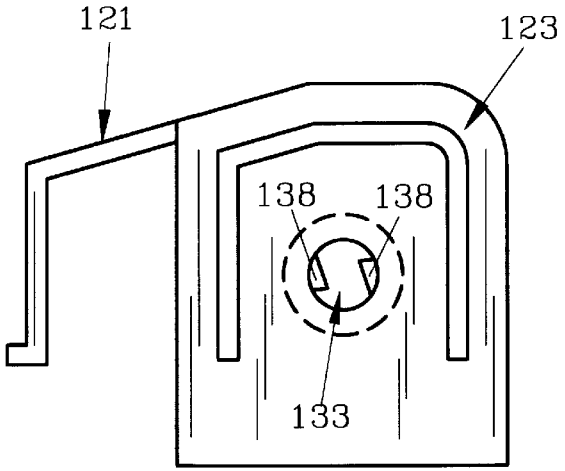

FIGS. 12 and 13 show housing 121 with first end cap 123 positioned thereon. Specifically seen in FIG. 12 are teeth 138 within toothed race 133. Alternate embodiments may utilize pivotal teeth which are adjustably movable to release the spring tension on core 122. Specifically seen in FIG. 13 is plug tongue 135 of end plug 125.

Figure 15:
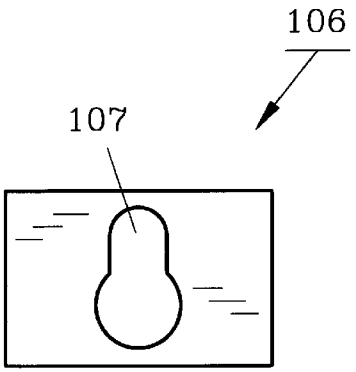
FIG. 15 features a plan view of the slidable hanger as seen in FIG. 14.
Figure 14:
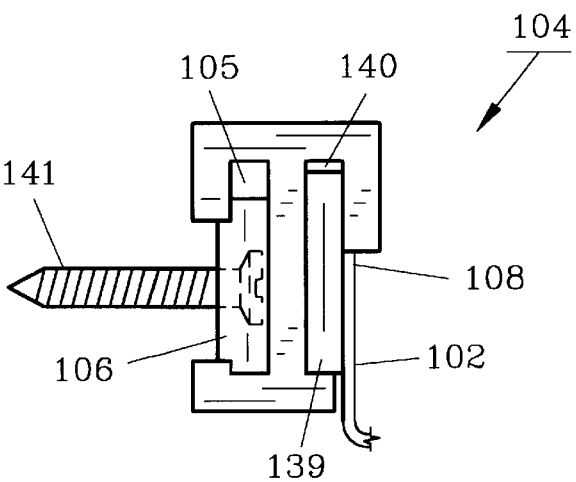
FIG. 14 illustrates an enlarged view of the slidable hanger positioned in the screen rail for attachment to the window sash.

FIGS. 14 and 15 show slidable hanger 106 which will move laterally along groove 105 as needed. Slidable hanger 106 is positioned in front groove 105 of screen rail 104. Screen 102 is attached at terminal end 108 to slide 139 which slides within back groove 140 of screen rail 104. Elongated member 141 is received within key hole shaped aperture 107 (FIG. 15) of slidable hanger 106 and allows screen rail 104 to pivot therearound as earlier explained to prevent binding of screen 102.

Figure 17:
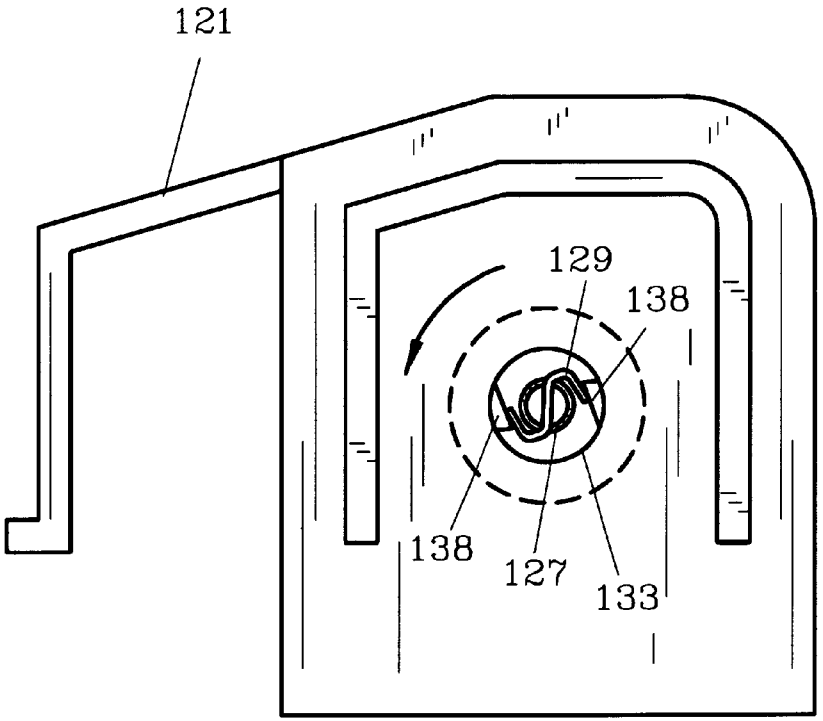
FIGS. 16 and 17 demonstrate the s-shaped pawl in action as the spring-loaded core is wound.
Figure 16:
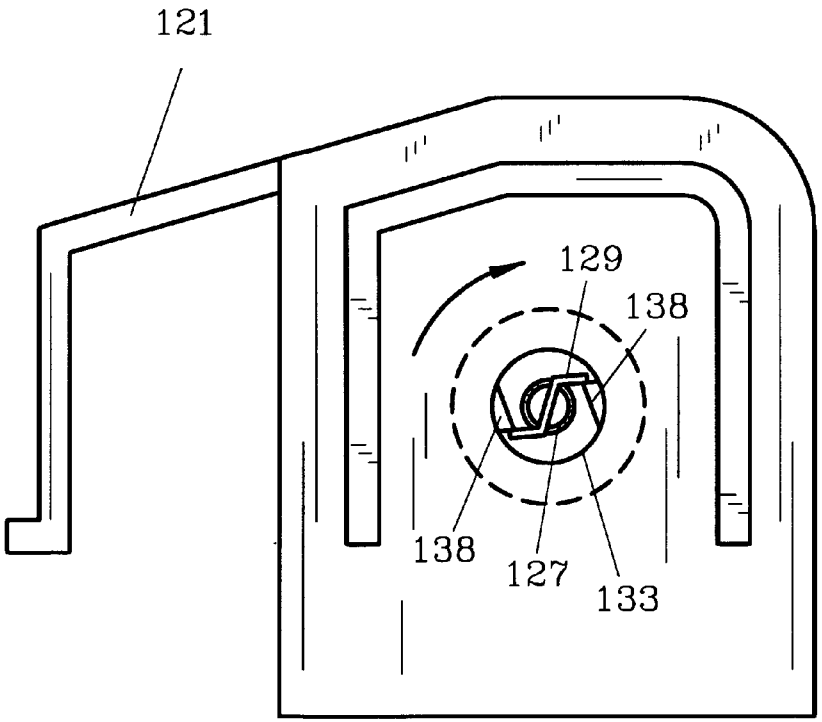

As further seen in FIGS. 16 and 17, s-shaped pawl 129 interacts with teeth 138 of toothed race 133 to facilitate tensioning spring 128 (FIG. 9) on spring axle 127. In FIG. 16, pawl 129 prevents clockwise rotation of core 122, whereas in FIG. 17, counterclockwise rotation of core 122 is permitted. This allows for manual tightening of spring 128 by turning end plug 125 with a screwdriver.

Figure 18:
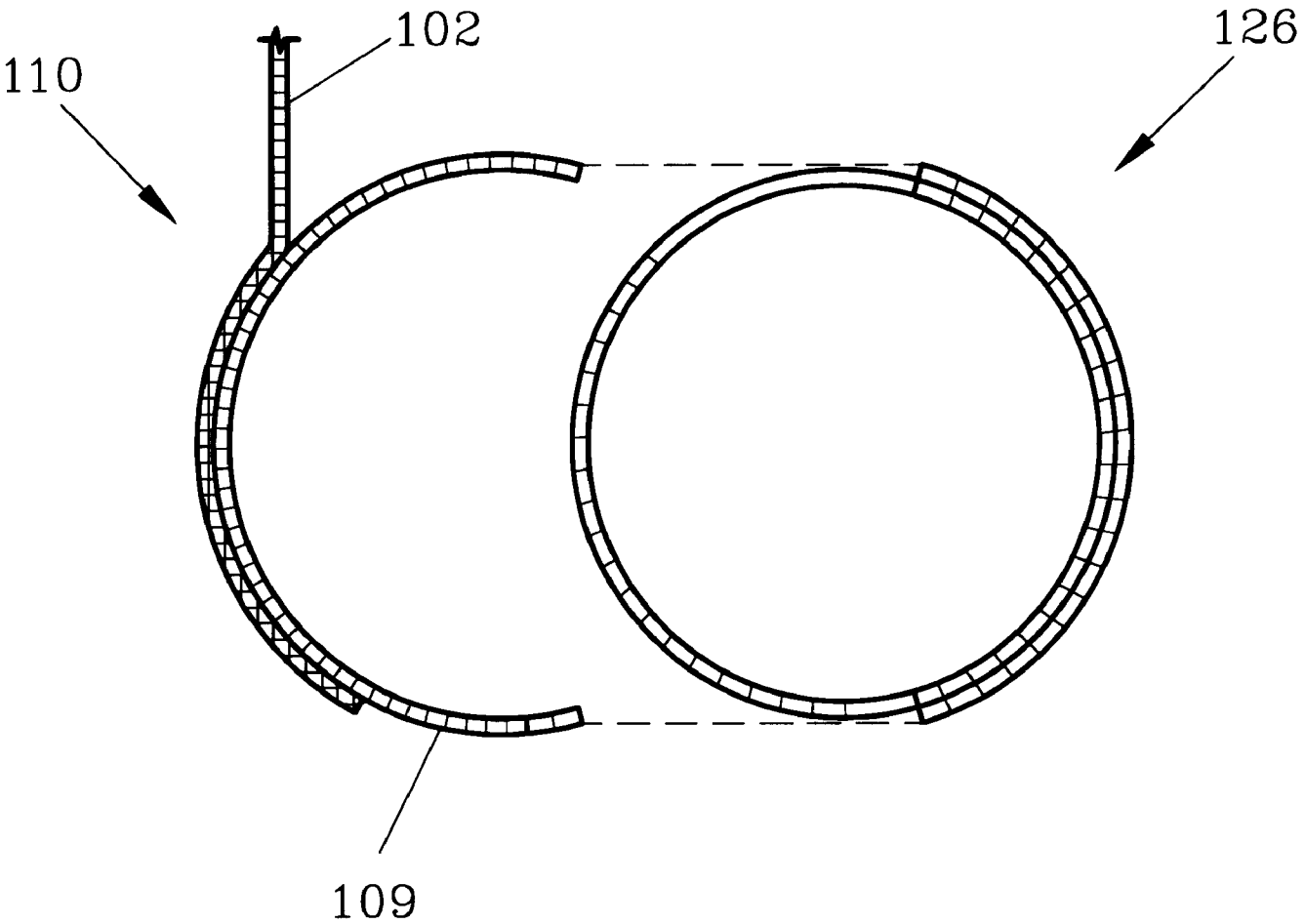
FIG. 18 provides a schematic cross-sectional enlarged view of the inner core section exploded from the c-shaped outer section having the screen affixed thereto.

Screen 102 is seen in FIG. 18 attached to the outer surface of c-shaped section 109 as earlier explained. This configuration allows for close tolerances and a smooth uniform core when assembled even if screen 102 has an uneven thickness or irregularity therein at its attachment.

The preceding recitation is provided as an example of the preferred embodiments and is not meant to limit the nature of scope of the present invention or appended claims.

I claim:

1. A retractable window screen assembly comprising:

a spring-loaded core, said core comprising:

a c-shaped outer section, an inner section, said c-shaped outer section for cooperative engagement with said inner section, a spring axle, said axle contained within said inner section, a spring, said spring positioned on said axle, a window screen, said window screen affixed to the outer surface of said c-shaped outer section whereby said spring-loaded core will wind said window screen therearound.

2. The retractable window screen assembly of claim 1 further comprising an end cap, said end cap for receiving said spring axle, said end cap defining a toothed race, a resilient pawl, said pawl attached to said spring axle contiguous said race whereby said pawl will fully rotate within said race as said axle is rotated in one direction to tension said spring and will be obstructed as said axle is rotated in the opposite direction.

3. The retractable window screen assembly of claim 2 wherein said pawl comprises an s-shaped member.

4. The retractable window screen assembly of claim 1 wherein said spring-loaded core further comprises an end plug, said end plug attached to said spring axle, said end plug defining a slot, a tongue, said tongue positioned opposite said slot on said plug.

5. The retractable window screen assembly of claim 4 wherein said spring axle defines an end slot, said end slot for reception of said tongue.

6. The retractable window screen assembly of claim 1 further comprising a screen rail, said rail defining a groove, a slidable hanger, said slidable hanger contained within said groove, said slidable hanger defining an aperture, said aperture for reception of a longitudinal member for pivoting thereon.

7. A retractable window screen assembly comprising:

a spring-loaded core, a housing, said spring-loaded core contained within said housing, said spring-loaded core comprising:

a coil spring, a spring axle, said axle having a length greater than said spring when said spring is fully relaxed, first and second end caps, said end caps for attachment to opposite ends of said housing, said end caps for supporting said spring-loaded core, said first end cap defining a toothed race, a pawl, said pawl attached to said spring axle and contained within said race whereby said pawl will turn freely within said race as said spring is tensioned by rotation of said spring axle and will prohibit rotation of said spring axle in the opposite direction by engaging a race tooth.

8. The retractable window screen assembly as claimed in claim 7 wherein said pawl comprises an s-shaped member.

9. The retractable window screen assembly as claimed in claim 7 wherein said spring axle defines an end slot, said end for receiving said s-shaped pawl.

10. The retractable window screen assembly as claimed in claim 7 wherein said first end cap further defines an axle cap race, said axle cap race adjacent said toothed race and aligned therewith, an end plug, said end plug for attachment to said spring axle for rotation within said axle cap race.

11. The retractable window screen assembly as claimed in claim 10 wherein said end plug defines a slot, a tongue, said tongue positioned on said end plug opposite said end plug slot.

12. The retractable window screen assembly as claimed in claim 11 wherein said tongue engages said end slot of said spring axle.

13. The retractable window screen assembly as claimed in claim 7 further comprising a core hub, said core hub attached to said spring-loaded core.

14. The retractable window screen assembly as claimed in claim 13 wherein said core hub defines a locking mechanism.

* * * * *